US006041550A

United States Patent [19]

Tix

[11] Patent Number: 6,041,550

[45] Date of Patent: Mar. 28, 2000

[54] RESILIENT COVER FOR COVERING A SPRING OF A JAMB LINER AND FOR ATTENUATING NOISE GENERATED BY SPRING MOVEMENT

[75] Inventor: Ronald E. Tix, Hastings, Minn.

[73] Assignee: Clim—A—Tech Industries, Inc., Hopkins, Minn.

[21] Appl. No.: 08/744,177

[22] Filed: Nov. 5, 1996

[51] Int. Cl.[7] ..... E05D 15/06; E05D 7/00

[52] U.S. Cl. ..... 49/404; 49/445; 49/447; 52/207

[58] Field of Search ..... 049/445, 446, 049/447, 448, 404, 428

[56] References Cited

U.S. PATENT DOCUMENTS

| | | | |
|---|---|---|---|
| 2,101,577 | 12/1937 | Gossen | 49/447 X |
| 2,786,230 | 3/1957 | Hettinger | 49/445 X |
| 2,885,725 | 5/1959 | Glass | 49/445 X |
| 2,913,781 | 11/1959 | Czubachowski | 49/445 X |
| 3,145,433 | 8/1964 | Jones | 49/447 X |
| 3,332,171 | 7/1967 | Beil | 49/445 |
| 4,028,849 | 6/1977 | Anderson | 49/446 X |
| 4,170,090 | 10/1979 | Wood | 49/430 X |
| 4,685,175 | 8/1987 | Yonovich | 49/446 X |
| 4,694,612 | 9/1987 | Pruden et al. . | |
| 4,887,389 | 12/1989 | Haltof . | |
| 4,932,453 | 6/1990 | Hoover et al. | 49/446 X |
| 4,949,506 | 8/1990 | Durham, Jr. . | |
| 5,001,865 | 3/1991 | Procton | 49/498.1 X |
| 5,033,235 | 7/1991 | Stark . | |
| 5,042,199 | 8/1991 | Schneider et al. . | |
| 5,050,943 | 9/1991 | Barnett . | |
| 5,099,624 | 3/1992 | Valentin | 49/404 X |
| 5,414,962 | 5/1995 | Forbis et al. . | |

*Primary Examiner*—Daniel P. Stodola
*Assistant Examiner*—Gregory J. Strimbu
*Attorney, Agent, or Firm*—Alan Kamrath; Oppenheimer, Wolff & Donnelly LLP

[57] ABSTRACT

An elongated cover is removably mounted to a channel guide of a jamb liner for a window unit that is mounted for movement between opened and closed positions. A balance spring in the channel guide has one portion attached to the top end of the jamb liner and an opposite end mounted to a balance shoe which frictionally engages the channel guide. The shoe is mounted to the lower end portion of the window unit. The cover includes a longitudinally elongated main body extendable within the channel guide, a resilient tube mounted to one transverse edge of the main body to abut against a channel guide side wall and rear wall to resiliently urge the main body away therefrom and a mounting joined to the main body transversely opposite the tube for forming a channel to engage a flange of the channel guide. The resilient action of the tube releaseably couples the cover to the channel guide to conceal the spring which extends above the window unit when the unit is closed or partially opened.

17 Claims, 2 Drawing Sheets

RESILIENT COVER FOR COVERING A SPRING OF A JAMB LINER AND FOR ATTENUATING NOISE GENERATED BY SPRING MOVEMENT

FIELD OF THE INVENTION

This invention relates to jamb liner apparatus for double hung windows, particularly to covers for removably concealing parts of springs of balance spring assemblies for jamb liners that otherwise would be visible and more particularly for vinyl jamb liners.

DESCRIPTION OF THE PRIOR ART

In particular, for double hung windows, especially those having plastic jamb liners, each jamb liner has a double track or channels in which there are slideably mounted shoes of balance spring assemblies. The shoes are mounted to the lower portions of the top and bottom window units while balance springs at their lower ends are attached to the shoes and at their upper ends are attached to the upper end of the adjacent jamb liner. Unless other provisions are made such as mentioned below, when the lower window unit is in its closed position, the lower unit spring is visible from the top of the lower window unit to the upper end of the jamb liner. One prior art approach of providing a more appealing aesthetic appearance has been to glue or sonically weld covers to the jamb liner to substantially conceal the springs that otherwise are visible when the lower window unit is closed and/or the upper window unit is at least partially open. However, a disadvantage of such approach is that, if it is necessary to adjust the window raising mechanism, it is necessary to break the attachment of the cover to the window jamb liner.

Another approach is to provide a balance housing joined to and extending the length of the jamb liner with a balancing shoe and a tension spring, for example, see U.S. Pat. No. 5,033,235. The balance housing has a slot, through which the sash support extends, opening so as to conceal the spring and the friction balance device.

When using balance spring assemblies, during the raising and lowering of a window unit, the stretching and relaxing of the springs generate undesirable spring noises. One prior art approach for minimizing this problem has been to wrap the springs with sponge like material prior to welding the covers to the window jamb liners, this involving a two step approach. Another approach has been to provide a sponge like material in the jamb liners in abutting relationship to the springs.

In order to provide improved apparatus for concealing at least substantially all of the balance springs for single or double hung windows, this invention has been made.

SUMMARY OF THE INVENTION

The present invention relates to jamb liners mountable in recessed tracks of the side jambs of the frame for double hung windows which include window units translatorily movable between open and closed positions. Each jamb liner has a first and a second longitudinal elongated channel guide with a first and second balance shoe attached to the respective upper and lower window unit and located in the respective channel guide. A first and a second balance spring extends within the respective channel guide and is attached to the first and second shoe respectively to extend adjacent to the top of the respective jamb liner and to be attached thereto. An elongated cover is provided for each lower window unit channel guide to conceal at least substantially all of a balance spring that otherwise would be visible through the respective channel slot when the window unit is closed. Each cover is easily removably attachable to the adjacent jamb liner. Further, each cover includes a main body having a tab or lip extending the length of the main body and away from the main body for abutting against the adjacent balance spring to substantially eliminate or minimize the noise (noise abatement) of the spring as the window unit is moved between its raised and lowered positions. As a result, in mounting the cover to a jamb liner, the balance spring is concealed together with abating spring noise when the window unit is moved.

One of the objects of this invention is to provide new and novel means for concealing at least a major portion of the balance spring that is attached to a translatorily movable window unit in a Window frame. A further object of this invention is to provide for window unit balance spring assemblies, new and novel means for concealing parts of a spring assembly that is removably attachable to a jamb liner to facilitate removal when it is desired to adjust the resistance to movement of a window unit in jamb liners of a window. In furtherance of the last mentioned object, it is another object of this invention to provide new and novel jamb liner cover means for abating spring noise as a window unit is moved between its raised and lowered positions.

DETAILED DESCRIPTION

Figure 1:
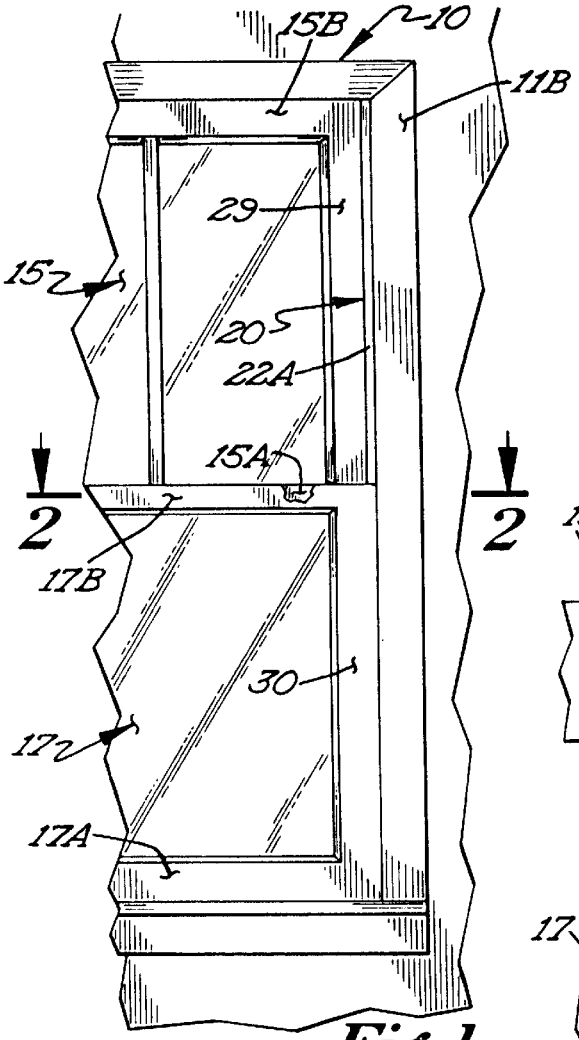
FIG. 1 is a front view of a window.
Figure 3:
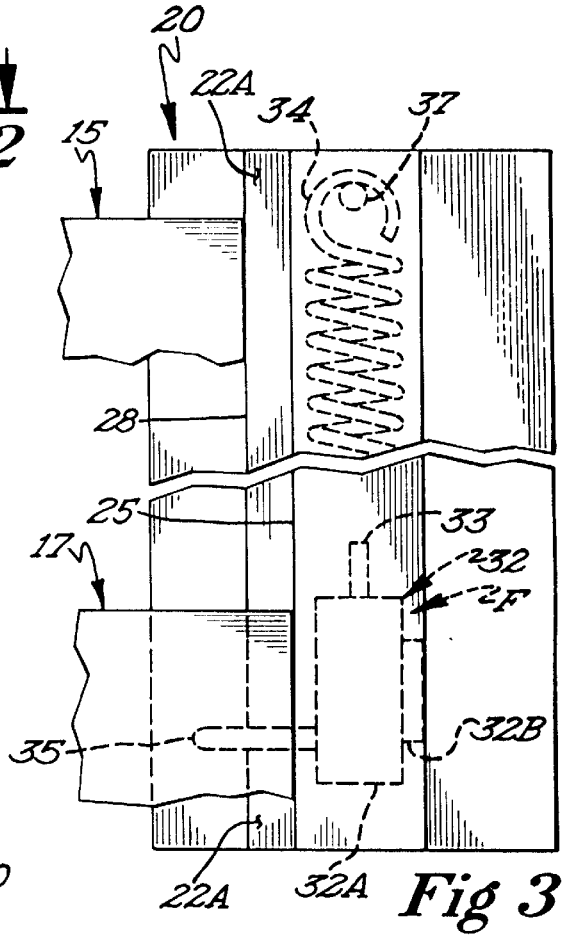
FIG. 3 is a fragmentary, somewhat diagrammatic view of the jamb liner with a balance spring and balance shoe therein and window unit sashes, with a vertical intermediate portion broken away, said view being generally taken along the line and in the direction of the arrows 3—3 of FIG. 2 but with the window units being opened.
Figure 2:
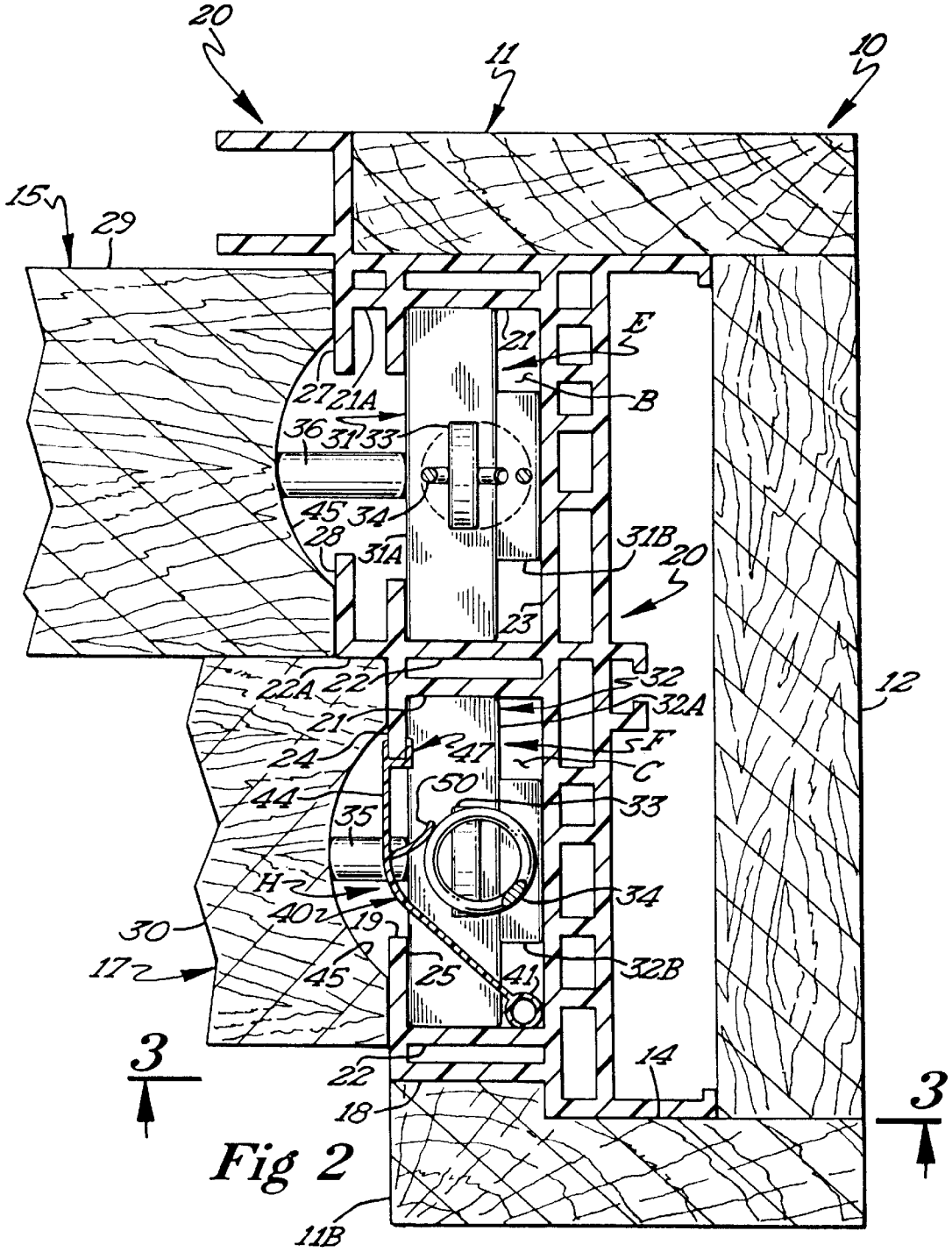
FIG. 2 is an enlarged cross sectional view of a jamb liner, balance spring cover and a somewhat diagrammatic showing of balance shoes in channel guides of the jamb liner, together with fragmentary portions of a window frame and window sashes of window units, said view being generally taken along the line and in the direction of the arrows 2—2 of FIG. 1.

Referring in particular to FIGS. 1 and 2, there is shown a side jamb member, generally designated 10, of one side of a conventional window frame having a window opening. The frame jamb member 10 includes oppositely facing transversely spaced abutments 11 joined to a frame side web (side jamb) 12 to provide a recessed longitudinal track that includes a generally rectangular groove 18 opening toward the opposite side of the window frame and a recess 14 opening toward the remote abutment 11 and the groove 18. The frame abutment 11B is removable to facilitate the installation of the jamb liner, generally designated 20, even though the liner may be of a rigidity to permit the liner to be snapped into the recessed track. Advantageously, the jamb liner is made of plastic and is at least semi-rigid. The grooves and recesses extend along substantially the entire longitudinal length of the window frame opening in which the upper and lower window units, generally designated 15 and 17 respectively, are slidably mounted for movement between opened and closed positions. The lower window unit has a lower end portion 17A and an upper end portion 17B while the upper window unit has a lower end portion 15A and an upper end portion 15B.

For each of the frame side jambs, there is provided a jamb liner, generally designated 20, the jamb liners being designed for use with a double hung window and being mountable in the grooves 18 and recesses 14 to extend the longitudinal lengths of the tracks and transversely across the tracks. Each jamb liner includes a main body having parallel, transversely spaced, longitudinally elongated channel guides B, C. Each channel guide has transversely opposite side walls 21 and 22 and a rear end wall 23 extending between and joined to the longitudinal rear edges of walls 21 and 22. To the longitudinal front edges of the transversely spaced walls 21 and 22, which are opposite the end wall 23 of channel guide C, there are joined front extending liner flanges 24 and 25. As to channel guide B, to the front edges of side walls 21 and 22 there is respectively joined wall extensions 21A and 22A which in turn have liner flanges 27 and 28 joined to the front edges thereof. The flanges of each channel guide extends toward one another substantially parallel to the end walls 23 to terminate substantially transversely spaced from one another to provide a guide slot 19 extending the length of the jamb liner.

To counterbalance the weight of the upper and lower window units, there are provided spring balance assemblies E and F respectively. Spring balance assembly E includes a conventional balance shoe 31 mounted in the upper window unit channel guide B for vertical slidable movement shoe 31 has a brake mount 31A that mounts a brake portion 31B for frictionally engaging the rear wall 23. The balance spring assembly F includes a conventional balance shoe 32 mounted in the lower window unit channel guide C for vertical slidable movement shoe 32 has a brake mount 32B that mounts a brake portion for frictionally engaging the rear end wall 23. Advantageously, each brake portion is adjustable in a conventional manner by a mechanism (not shown) to permit selectively varying the frictional contact with the respective guide end wall. The brake mounts of the shoes 31 and 32 are suitably mounted to the lower end portions of the side sashes 29 and 30 of the upper and lower window units by fasteners 36 and 35 respectively, for example pins to the lower end portion of the respective window unit. Mounted to the upper end portion 33 of each shoe brake mount and within the respective channel guide is the lower end of a coiled balance spring 34 of the respective spring balance assembly while the upper end of each spring is suitably mounted to the upper end portion of the jamb liner, for example, a fastener (pin) 37 with the spring extending downwardly therefrom.

For the lower window unit guides C, there are provided elongated, removable covers H, each cover including a main body, generally designated 40, and a longitudinally elongated resilient member 41 which advantageously may be a tube that, advantageously, extends the length of the main body. The cover main body is semi-rigid while the tube is made of a flexible polymer that is of a substantially greater resiliency than the main body. That is, the main body is made of a different material than the tube. The outer peripheral wall of the tube is joined to one transverse terminal edge 40A of the main body.

Figure 4:
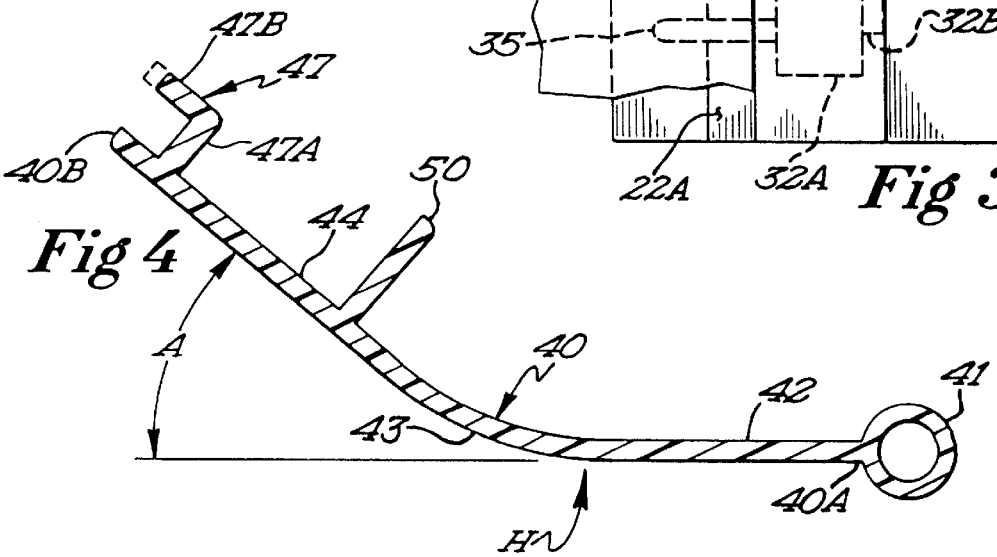
FIG. 4 is an enlarged end view of the balance spring cover in a relaxed condition.

The main body 40 in transverse cross section, when in the relaxed condition of FIG. 4, includes a substantially transversely linear first portion 42 having the longitudinal terminal edge 40A joined to the tube 41 to extend radially outwardly from the tube. The opposite longitudinal edge of the first portion 42 is joined to one longitudinal edge of a cover transversely bent (second) portion 43, which advantageously is transversely bowed (arcuately curved) about one or more radii of curvature along its transverse dimension. The opposite longitudinal edge of the bent portion is joined to one longitudinal edge of the generally transversely linear third portion 44 of the cover main body. The third portion 44 has a free terminal edge 40B of the main body transversely opposite edge 40A. Advantageously, the third portion 44 extends transversely relative to the first portion 42 at an angle A which advantageously is 35 to 55 degrees and desirably about 45 degrees. However, the angle A may be larger or smaller in that angle A in part depends on the relative transverse dimensions of the main body portions, the horizontal dimension of the guide slot 19, the spacing of flanges 24 and 25 from the end wall 23 of side C and the spacing of guide walls 21 and 22 of channel guide C from one another. Advantageously, the arcuate dimension of the bent portion 43 may be about the same as the transverse linear dimension of each of the portions 42 and 44 while the thickness of the main body throughout its length and transverse width advantageously is substantially the same.

Joined to cover main body adjacent to the terminal edge 40B in transverse spaced relationship is a right angle mounting flange 47. The flange 47 has a leg 47A that is joined to main body portion 44 to extend at about right angles and is spaced from edge 40B by a distance which desirably is greater than the thickness of liner flange 24 of guide C. The flange leg 47B is joined to leg 47A to be spaced from main body portion 44 by a distance a little greater than the thickness of the liner flange 24, parallel to main body portion 44 and advantageously extends transversely away from leg 47A further than main body portion 44 extends transversely away from tube 41. The angle mounting flange 47 and the part of the cover main body to which the flange is joined and extends transversely away from the leg 47A in a direction transversely away from second portion 43 provides a longitudinally elongated cover terminal edge portion forming a channel with opposing side walls for having the flange 24 extending thereinto in abutting relationship.

Joined to main body portion 43 adjacent to its juncture to main body portion 44 is a spring hold in tab (lip) 50 that advantageously is of the same longitudinal length of the cover main body. The lip 50 is of a resiliency (flexibility) substantially greater than that of the cover main body and advantageously may be made of the same material as the tube 41. The lip at its juncture to the main body portion 43 extends away from main body portion 43 at about right angles and extends away from the main body in nearly the same direction that flange leg 47A extends away from the cover main body.

The cover, in its relaxed condition, is of a transverse dimension such that when the tube 41 abuts against the walls 22 and 23 of channel guide C adjacent to the intersection of said walls, the flange legs 47A and/or 47B are abuttable against guide flange 24 with leg 47B being between flange 24 and wall 23 and flange 24 being between the main body and leg 47B. That is, the liner flange 24 extends into the channel defined by the cover main body and mounting flange 47. The tube is of a resiliency to retain the cover in the above relationship. At least the lower window unit side sashes have notches 45 opening toward the slots 19 whereby the window unit in being moved between lowered and raised positions, does not abut against the covers.

The cover may be mounted to the channel guide C by extending the tube 41 into the guide C and then, upon pushing cover main body edge 40B toward the intersection of walls 22 and 23 of guide C, the tube 41 collapses (resiliently yields) sufficiently that flange leg 47B can be moved inwardly toward wall 23 and after so doing, the main body is allowed to move resiliently outwardly to have guide flange 24 extend between main body portion 44 and flange leg 47B for retaining (coupling) the cover mounted to the jamb liner. The cover may be removed by manually pushing the cover terminal edge portion 40B toward flange 25 and moving it away from the end wall 23 to clear the edge of the flange 24 and then the leg 47B out of the channel guide. Thus, the terminal end portion of the cover transversely opposite the tube provides means for removably mounting (coupling) the cover to the jamb liner. The included angle of planes of main body portions 42 and 44 which opens in the same general direction that the coupling leg extends away from the main body is advantageously about 125 to 145 degrees in the cover datum relaxed position of FIG. 4.

The cover, when mounted to channel guide C, is of a length to extend from closely adjacent to and above the fastener 35 when the lower window unit is in its fully open position to closely adjacent to the top of the jamb liner. When the cover is thus placed in the lower window unit channel guide, the main body portions 42 and 44 extend generally transversely relative to one another at an angle that in part opens to the rear end wall 23 at a smaller angle than the corresponding angle of about 125 to 145 degrees when the cover is in its relaxed condition. Accordingly, the tube, in abutting against at least one of the rear end wall 23 and side wall 22 of the channel guide, resiliently urges the main body toward the flange 24 whereby the flange 47 cooperates with the main body portion 44 to releaseably couple the main body to the channel guide flange 24.

The tube 41 is of an outer diameter and a resiliency to, in combination with the curvature of the bent portion 43 and the flexibility of the main body 40, retain the cover in a mounted position even though there are some variations in the width of the slots 19 from one jamb liner to another. The flexibility (resiliency) of the tube is much greater than the flexibility of the cover main body.

Due to the flexibility of the cover main body, as the cover is moved into the channel guide C, in addition to the tube being compressed, the main body terminal edges 40A and 40B move from the main body relaxed datum condition such as shown in FIG. 4 to be more closely adjacent to one another as the transverse curvature of the bent portion (decreases) and the angle A (increases) changes to an insertion condition. The extent of change from the datum position decreases as the manual force exerted on the cover, when in an insertion condition abutting against the corner of the guide C, is decreased. The decrease in manual force applied is subsequent to the mounting flange having been moved into the guide whereby the cover terminal edges move transversely away from one another and the tube resiliently expands toward its relaxed condition to the cover mounted (captured) condition illustrated in FIG. 2 with the guide flange 24 extending into the cover channel. Further, advantageously, when the cover is in its mounted condition of FIG. 2, the relative transverse dimensions of the main body portions 42, 43 and 44 together with the relative angles of extension of these portions relative to one another is such that the combination of the main body portion 44 and the adjacent part of portion 43 extend nearly parallel to guide flanges 24 and 25, with said combination extending substantially more than half of the transverse distance from main body flange 24 to the main body flange 25.

When the cover is mounted to the jamb liner as described in the preceding paragraphs, the lip 50 abuts against the balance spring to greatly reduce the noise that otherwise would be generated by the spring as the lower window unit is moved between its open and closed positions. Thus, the coil spring of each of the balance spring assemblies for the lower window unit is located between the cover and the rear end wall 23 of the respective channel guide C. Further, the mounted cover(s) conceals at least substantially the entire balance spring(s) in guide(s) C from the top of the lower window unit to the top of the jam liner(s) when the lower window unit is closed or partially closed, with the part of the balance spring(s) not located transversely between the cover and wall 23 being concealed by the lower window unit. Advantageously, the cover main body is of the same color as the jamb liner for aesthetic reasons.

Although the cover in its mounted position has been described with the tube abutting against walls 22 and 23 and the guide flange 24 extending into the cover main body channel defined by main body portion 44 and mounting flange 47, it is to be understood that if desired, the cover may be mounted to have the tube abut against walls 21 and 23 and guide flange 25 extended into the cover main body channel. Further, even though the bent portion has been described as being arcuately curved, it is to be understood that the bent portion may be made up of more than one transverse part, for example the part of the bent portion 43 adjacent to portion 44 may be initially transversely curved about a smaller radius of curvature and then transversely extend linearly therefrom, for example nearly parallel to portion 44, to portion 42 to function in a manner substantially the same as described with reference the form of the cover illustrated.

Even though it is preferred that the cover include a resilient tube 41, it is to be understood that the cover may be modified wherein the tube is eliminated together with extending the transverse dimensions of the cover main body portions to have the terminal longitudinal edge portion transversely opposite the cover channel defined by main body portion 44 and mounting flange 47 abutting against the channel guide adjacent to the intersection of walls 22 and 23 of channel guide C with the main body portions transversely flexed out of their relaxed condition to retain the modified cover in its mounted position. The thus modified cover (not shown) may be mounted and removed in a manner similar to that described with reference to cover H. It is to be noted that each of the thus modified cover and cover H are of a flexibility to permit the covers being flexed to move their transverse opposite longitudinal end portions transversely more closely adjacent to one another for being mounted to the guide and removed from the guide as described and have a memory to return (rebound) to the cover datum relaxed condition when removed from the channel guide C.

Advantageously, the plastic material forming the cover is extruded in elongated lengths which then may be transversely cut to provide more than one cover of the desired length for guide channels C.

Even though one particular transverse cross sectionally shaped jamb liner has been illustrated, it is to be understood the cover of this invention may be utilized with other transverse cross sectional shaped jamb liners, and if necessary, the transverse dimensions of the cover main body portions, the transverse shape of the bent portion, the angle A and the diameters of the tube 41 may be varied. As one example of a different cross sectionally shaped jamb liner, the guide flanges 24, 25, 27 and 28 may be located in a common plane.

Even though the abutment 11B has been shown as extending near the same distance as the guide flange is spaced from the side web 12 it is to be understood no such abutment need be provided, or may extend only a part of said distance. The covers of this invention are particularly desirable for vinyl jamb liners wherein there is no wood framing that in part extends around the jamb liners.

What is claimed is:

1. A cover for removable attachment to a jamb liner including first and second side walls, a rear wall and a front flange said cover, comprising, in combination: an elongated cover main body having first and second longitudinal terminal edges; means provided at the first longitudinal terminal edge for releasably coupling the first longitudinal terminal edge to the front flange; and means provided at the second longitudinal terminal edge for abutting against at least one of the rear wall and the second side wall and for resiliently urging the elongated cover main body away from the at least one of the rear wall and the second side wall for retaining the releasably coupling means on the front flange.

2. The cover of claim 1 wherein the abutting, resiliently urging and retaining means comprises an elongated resilient member provided at the second longitudinal terminal edge.

3. The cover of claim 2 wherein the cover main body is made of a first material; and wherein the abutting, resiliently urging and retaining means is made of a second material that is more flexible than the first material.

4. The cover of claim 2 wherein the abutting, resiliently urging and retaining means comprises an elongated, resilient tube.

5. The cover of claim 1 further comprising, in combination: means joined to the elongated cover main body for abutting against a coil spring located between the front flange and the rear wall and for abating noise generated by stretching and relaxing the coil spring.

6. The cover of claim 5 wherein the abutting and noise abating means comprises an elongated lip joined to and extending from the elongated cover main body.

7. The cover of claim 6 wherein the cover main body is made of a first material; and wherein the abutting and noise abating means is made of a second material that is more flexible than the first material.

8. The cover of claim 5 wherein the releasably coupling means comprises an elongated channel formed at the first longitudinal terminal edge and adapted to receive the front flange.

9. The cover of claim 8 wherein the releasably coupling means comprises a flange leg spaced from the cover main body a distance a little greater than a thickness of the front flange, wherein the releasably coupling means is adapted to receive the front flange between the cover main body and the flange leg.

10. The cover of claim 1 wherein the releasably coupling means comprises an elongated channel formed at the first longitudinal terminal edge and adapted to receive the front flange.

11. The cover of claim 1 wherein the cover main body has a datum relaxed condition and is of a flexibility to permit being flexed to move the first and second longitudinal terminal edges more closely adjacent to one another than in the datum relaxed condition to an insertion condition for insertion into the jamb liner and to be reboundable from the insertion condition towards the datum relaxed condition.

12. A cover for removable attachment to a jamb liner including first and second side walls, a rear wall, and a front flange said cover comprising, in combination: an elongated cover main body having first and second longitudinal terminal edges; means provided at the first longitudinal terminal edge for releasably coupling the first longitudinal terminal edge to the front flange, the second longitudinal terminal edge adapted to abut against at least one of the rear wall and the second side wall; and means joined to the elongated cover main body for abutting against a coil spring located between the front flange and the rear wall for abating noise generated by stretching and relaxing the coil spring.

13. The cover of claim 12 wherein the abutting means comprises an elongated lip joined to and extending from the elongated cover main body.

14. The cover of claim 13 wherein the cover main body is made of a first material; and wherein the abutting means is made of a second material that is more flexible than the first material.

15. The cover of claim 14 wherein the releasably coupling means comprises an elongated channel formed at the first longitudinal terminal edge and adapted to receive the front flange.

16. A cover for removable attachment to a jamb liner including first and second side walls, a rear wall, and a front flange, said cover comprising, in combination: an elongated cover main body having first and second longitudinal terminal edges; and means provided at the first longitudinal terminal edge for releasably coupling the first longitudinal terminal edge to the front flange, said means for releasably coupling comprising an elongated channel formed at the first longitudinal terminal edge and adapted to receive the front flange, the second longitudinal terminal edge adapted to abut against at least one of the rear wall and the second side wall and means joined to the main body for cover abutting against a coil spring located between the front flange and the rear wall for abating noise generated by stretching and relaxing the coil spring.

17. The cover of claim 16 wherein the releasably coupling means comprises a flange leg spaced from the cover main body a distance a little greater than a thickness of the front flange, wherein the releasably coupling means is adapted to receive the front flange between the cover main body and the flange leg.

* * * * *

UNITED STATES PATENT AND TRADEMARK OFFICE
CERTIFICATE OF CORRECTION

PATENT NO : 6,041,550

DATED : March 28, 2000

INVENTOR(S) : Ronald E. Tix

It is certified that error appears in the above-identified patent and that said Letters Patent are hereby corrected as shown below:

Column 2, line 17, cancel "Window" and substitute therefor -- window --.

Column 3, line 28, cancel "shoe" and substitute therefor -- . Shoe --.

Column 3, line 33, cancel "shoe" and substitute therefor -- . Shoe --.

Column 7, line 7, cancel "said cover," and substitute therefor -- , said cover --.

Column 7, line 25, cancel "elongated," and substitute therefor -- elongated --.

Column 8, line 10, cancel "said cover," and substitute therefor -- , said cover --.

Column 8, line 42, cancel "main body for cover" and substitute therefor -- cover main body for --.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*